United States Patent [19]

Caoduro

[11] Patent Number: 4,955,793

[45] Date of Patent: Sep. 11, 1990

[54] TURBOPUMP AND SIMILAR OPERATING MACHINE WITH SEALING CONNECTION STRUCTURE TO THE MOTOR

[75] Inventor: Bruno Caoduro, Montecchio Magg., Italy

[73] Assignee: NOWAX s.r.l., Vicenza, Italy

[21] Appl. No.: 310,677

[22] Filed: Feb. 14, 1989

[30] Foreign Application Priority Data

Aug. 17, 1988 [IT] Italy ..... 85628 A/88

[51] Int. Cl.[5] ..... F04D 17/08; F04D 29/04

[52] U.S. Cl. ..... 417/423.11; 277/93 R

[58] Field of Search ..... 417/423.11, 423.12, 417/423.13, 423.14, 423.1; 415/170.1, 174.2; 384/481; 277/93 R, 935 D

[56] References Cited

U.S. PATENT DOCUMENTS 3,552,888 1/1971 Ericksson ..... 415/171.1
3,796,507 3/1974 Smykal ..... 415/174.2
4,810,174 3/1989 Stuckey ..... 417/423.14

FOREIGN PATENT DOCUMENTS 711047 6/1965 Canada ..... 417/424

*Primary Examiner*—Leonard E. Smith
*Assistant Examiner*—David L. Cavanaugh
*Attorney, Agent, or Firm*—Wenderoth, Lind & Ponack

[57] ABSTRACT

A turbopump or the like operating machine driven by a motor includes a casing for the motor having, at one end, a supporting flange for at least one first bearing of the motor shaft and, at the other end, a structure for coupling with a casing of the turbopump. The coupling structure comprises a single coupling flange, which includes a first supporting structure for a fixed sealing element interacting with a movable sealing element associated with the motor shaft and a second supporting structure for at least one second motor shaft bearing. Such first and second supporting structures are rigidly connected to the coupling flange proximate to a central portion thereof and at adjacent positions along the motor shaft.

7 Claims, 1 Drawing Sheet

TURBOPUMP AND SIMILAR OPERATING MACHINE WITH SEALING CONNECTION STRUCTURE TO THE MOTOR

BACKGROUND OF THE INVENTION

The field of present invention is that of the operating turbomachines such as hydraulic turbopumps, axial compressors, and radial or radial-axial compressors, driven by electric motors, and relates in particular to the structure of the casing of such a machine.

There are known casings of universal electric motors, i.e. motors which can be coupled to any user device or operating machine. In particular, a motor casing with forced air ventilation is known and described in Italian patent application No. 85621/A/88 filed on 8.26.1988, and assumed included herein by reference by way of example, with regard to the structure of the jacket. In such known motor casing, a pair of cylindrical jackets are arranged coaxially so as to form a toroidal interspace which is open at the end sections thereof and divided by ribs to define longitudinal channels for the cooling air impelled by a fan fitted on the motor shaft. In this casing, at the end thereof adjacent to the cooling fan there is arranged a first flange which supports with a central portion thereof a first rotor bearing. The other end the casing is closed by a second flange which supports a second rotor bearing and is connected with a universal coupling flange suitable for coupling with any standard operating machine. Such two end flanges therefore essentially have the function of supporting the bearings of the motor shaft and only one of them also has a coupling function.

As is known, if the machine is a fluid impelling machine, the coupling structure of the casing must also provide, amongst others, a sealing function against the fluid to be processed.

In another known motor casing structure, which is specifically intended for coupling with a hydraulic pump, the coupling assembly essentially includes at least three flanges, the first of which supports a rotor bearing and simultaneously provides a fixing point for the outer body of the pump. A second flange, or sealing shield, provides a seal against the fluid to be processed and defines at the same time the closure wall of the pump diffuser a third flange, essentially frustoconically shaped, stiffens and connects the first two flanges. Though this known structure entails some advantages with respect to the prior art, it is not free from disadvantages, among which mention is made, first of all, of the fact that the sealing rings mounted on the second flange are subjected to axial movements with respect to those mounted on the motor shaft, consequently causing a considerable loss of efficiency of the seal and occasional leakage of fluid. This is caused by the fact that the second flange is forced by the internal pressure of the impelled fluid, and "breaths" like a sort of plenum chamber independently from the first flange supporting the bearing, and therefore the central region of the second flange carrying the sealing ring is subjected to axial movements which are generally opposite to the axial displacemants of the motor shaft due to the fluidodynamic reaction exerted on the impeller.

A further disadvantage resides in the substantial considerable complexity of construction the assembly, which is formed by a large number of components and furthermore requires numerous and rather laborious welds, with obviously nagative effects on both the quality and the final precision of the assembly as well as on production costs.

SUMMARY OF THE INVENTION

The purpose of the present invention is to provide a casing structure for a turbine machine, comprising a coupling structure between the electric motor and the turbine machine which eliminates the disadvantages described above so as to be technically effective and economically competitive.

Within the scope of the above described purpose, a particular object of the invention is to provide a coupling structure providing a seal which is constantly effective in any operating condition.

A further object of the present invention is to provide a simplified coupling structure requiring a minimal number of components and assembly operations.

Another object of the invention is to provide a coupling structure which is reliable and has low maintenance costs, in order to make the assembly advantageous from either technical and economical points of view.

This purpose, as well as these and other objects which will become apparent hereinafter, are achieved by a turbopump or similar operating turbomachine powered by an electric motor and comprising a driving shaft, a motor casing, and a pump casing. At one end of the motor casing there is arranged a cover plate for supporting at least one first bearing of the motor shaft and at the other end of the motor casing there is arranged a second bearing for supporting the shaft while preventing axial displacement thereof. A structure couples the motor casing with the pump casing. A first annular sealing element is movably mounted on the shaft adjacent to the second bearing. The coupling structure comprises a single coupling flange defining a separating wall between the motor casing and the pump casing. A second annular sealing element is arranged for cooperation with the first annular sealing element. First supporting means fixedly holds the second sealing element and second supporting means fixedly holds the second bearing. The first supporting means and the second supporting means are rigidly associated with the coupling flange so that on operation the axial distance between the second sealing element and the second bearing is substantially constant, to thereby reduce any loss of sealing due to axial displacement of the first movable sealing element with respect to the second fixed sealing element.

It has been verified that with this arrangement the seal is improved exclusively by means of the single connecting flange.

BRIEF DESCRIPTION OF THE DRAWINGS

Further characteristics and advantages of the invention will become apparent from the description of a preferred but not exclusive embodiment of the structure according to the invention, illustrated only by way of non-limitive example in the accompanying drawings, wherein.

DETAILED DESCRIPTION OF THE INVENTION

Merely by way of non-limitative example, the described embodiment relates to a hydraulic turbopump, though it is evident that a different type of turbomachine could similarly embody the invention that will be described hereinbelow.

Figure 1:
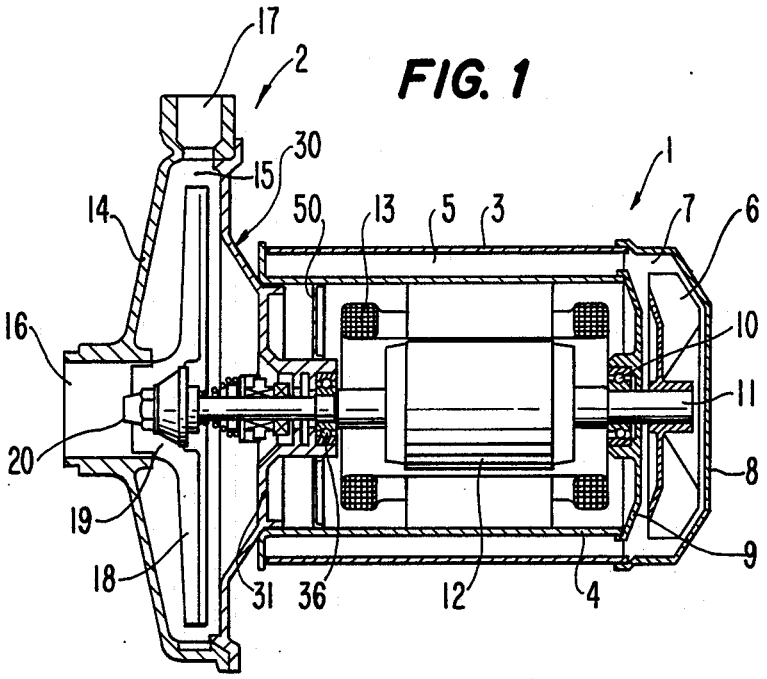
FIG. 1 is a partially sectional side view of a turbopump generally embodying a coupling structure according to the invention.

With reference to FIG. 1, the motor casing according to the invention is generally indicated by the reference numeral 1, while the pump casing is indicated by the reference numeral 2. In the illustrated example, the motor casing is of the double-jacket type, as described in the above mentioned Italian patent application No. 85621 A/88. It is furthermore evident that a different type of motor casing, for example a single-jacket casing, could be used without thereby departing from the scope of the present invention.

The motor casing 1 comprises a pair of cylindrical jackets 3, 4 mutually connected by a series of radial ribs 5 which define, together with the jackets, a plurality of longitudinal channels for conveying a laminar flow of cooling air. The air is impelled by a fan 6 which can rotate within a diffuser chamber 7 defined by an end wall 8 and by a first flange 9, which flange supports the outer ring of a first supporting bearing 10 of a motor shaft 11. A stator pack with its windings 13 is accommodated inside the motor casing 1 and encloses in a conventional manner a rotor 12 mounted on the shaft 11.

Figure 2:
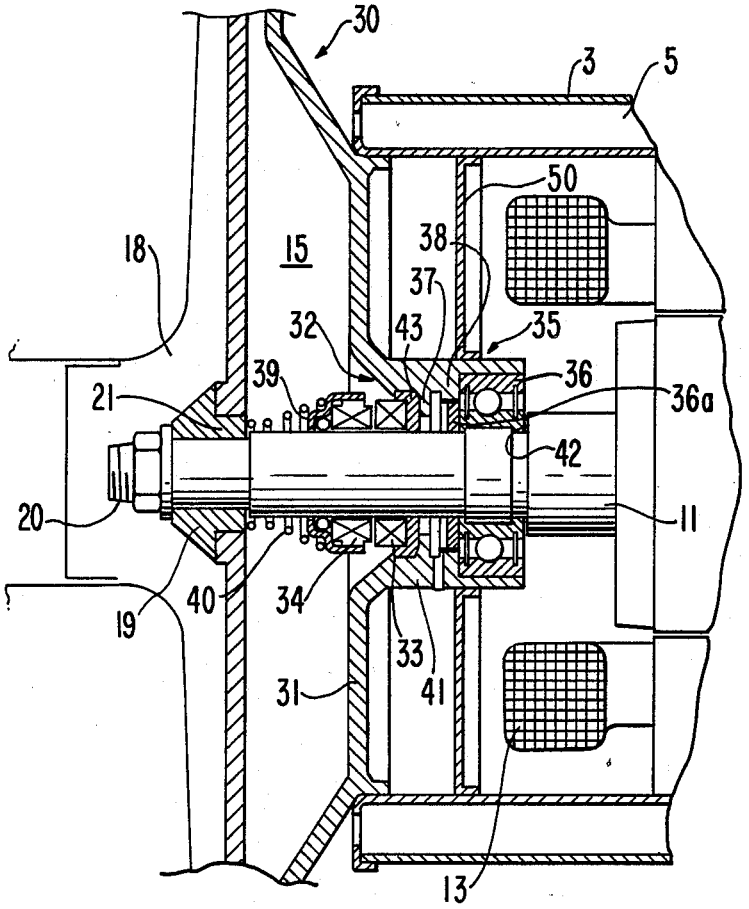
FIG. 2 is an enlarged side view of a particular embodiment of the coupling structure according to the invention.

At the end opposite to end wall 8 there is located a structure for closing the motor casing 1, which structure acts as a coupling and sealing wall for the pump casing 2. The pump casing further comprises an end wall 14 concavely shaped so as to internally define a spiral cavity or diffuser 15 (FIG. 2) having an inlet axial duct 16 and an outlet radial duct 17. An impeller 18 rotates inside the diffuser 15 with its hub 19 keyed to the motor shaft 11 by means of appropriate locking elements 20.

Turning to the coupling structure, this consists of a single coupling flange 30 which functions as a closure and separation wall between the motor casing 1 and the pump casing 2. These two casings are coupled by conventional connection means, such as screws or bolts, not illustrated in the figures, which are located proximate to the peripheral portion of the flange 30.

Optionally, a radial shield 50 is frictionally fitted within the inner jacket 4 between the flange 30 and the stator pack of the motor, to further prevent possible infiltration of humidity. The flange 30 comprises a radial and substantially planar peripheral portion 31 and a substantially tubular or cylindrical central portion 41, extending from the planar portion 31 towards the motor.

According to a unique characteristic of the invention, at the central portion 41 of the coupling flange 30 there is provided a first supporting means 32 for fixedly holding an annular sealing element 33 which interacts with a corresponding movable sealing element 34 slidably mounted on the motor shaft 11.

A second supporting means 35 is located at the central portion 41 of the flange 30 for holding the outer race of a second bearing 36 of the motor shaft 11. In a preferred embodiment, the first supporting means 32 comprises a first annular protrusion 37 which extends radially from the internal wall of the central portion 41 of the flange 30.

This radial protrusion 37 defines with the internal wall of the central portion 41 a first cylindrical seat for a retention bush 43 in which the annular sealing element 33 is rigidly mounted by press fitting. The bush 43 rests against a planar surface of the annular protrusion 37 and is prevented from axially displacing towards the rotor 12. The sealing element 34 associated with the motor shaft is in turn accommodated within a centering bush 39. This centering bush 39 has a stepped longitudinal section which defines on the outer surface thereof an annular abutment for a spiral compression spring 40 urging against a corresponding opposite abutment surface of a hub 21 of the impeller 20, so as to exert an adequate sealing action between the sealing elements 33 and 34.

Similarly, the second supporting means 35 comprises a second annular protrusion 38 which extends radially from the internal wall of the central portion 41 of the flange 30. This second annular protrusion 38 defines with the internal wall of the central portion 41 a second cylindrical seat within which the outer race of the bearing 36 is rigidly mounted by press fitting, bearing 36 abutting against an annular step 42 defined on the motor shaft 11 opposite to the annular protrusion 38.

From the foregoing described arrangement it is evident that the distance between the annular protrusions 37 and 38, as well as the distance between the fixed sealing element 33 and the bearing 36, are constant except for the unavoidable elasticity of the materials employed. As a consequence, all pressure variations acting on the flange 30 and tending to move the central portion 41 thereof towards and away from the motor cause the fixed sealing element 33 and simultaneously the bearing 36 to move in a concurrent direction. The movement towards the motor is transmitted to the shaft 11 thtough the internal race of the bearing 36 thus causing the immediate recovery of any momentary play or loss of seal between the sealing elements 33, 34.

The action exerted by the fluid inside the spiral cavity, which pushes the flange 31 to the right as viewed in the drawing is, furthermore substantially and proportionally balanced by the fluidodynamic forces acting in the opposite direction on the impeller 18, such forces being transmitted to the flange 31 through the shaft 11 and the bearing 36.

The coupling structure is of simple construction since it basically consists of the only flange 30 and therefore requires a smaller amount of material and considerably shorter production times then known structure of the art.

In the illustrated embodiment, both the pump casing 14 and the coupling flange 30 are obtained by casting materials such as cast-iron or other light alloys. In this case, the annular protrusions 37, 38 are integral with the central portion of the flange 31.

In an alternative embodiment, both the pump casing 14 and the coupling flange 30 may be formed of stainless steel or other oxidation-resistant materials, possibly treated, and may be obtained using per se known casting or stamping methods. In such case, the peripheries are mutually connected by means of circumferential welds or other equivalent coupling means. In this last case, the first annular protrusion 37 may be provided directly on the central portion of the flange 31, while the second annular protrusion 38 may be formed on the cylindrical portion 41, this latter being finally welded to the planar portion 31 of the flange 30.

In practice it has been observed that the coupling structure according to the invention fully achieves the intended aim and objects, as it provides a motor-pump coupling which is both technically and economically advantageous.

The structure thus conceived is susceptible to numerous variations and modifications, all of which are within the scope of the inventive concept as defined in the accompanying claims; moreover, all of the above described details may be replaced with technically equivalent elements. In particular, the structure according to the invention may be obtained by cast-iron or aluminum-alloy casing, in which case the annular protrusions which form the first and second supporting means are enbloc with the middle portion of the coupling flange.

In practice, the materials employed, so long as compatible with the specified use, as well as the dimensions and shapes thereof, may be selected according to the requirements and the state of the art.

I claim:

1. An electrically operated turbopump or similar turbomachine comprising:

an electric motor assembly including a tubular motor casing having a first and second ends, a cover closing said first end of motor casing, and a drive shaft rotatably mounted within said motor casing by a first bearing supported by said cover and by a second bearing adjacent said second end of said motor casing and prevented from axial displacement relative to said motor casing;

a pump assembly including a pump casing, an impeller housed within said pump casing drivingly connected to said drive shaft, a sealing structure including a movable first annular sealing element mounted on said drive shaft at a position adjacent said second bearing, a fixed second annular sealing element stationarily positioned about said drive shaft at a location between said second bearing and said movable first annular sealing element, and spring means urging said movable first annular sealing element toward said fixed second annular sealing element to thereby achieve a seal therebetween; and a coupling structure rigidly connecting said motor assembly to said pump assembly, said coupling structure comprising a single coupling flange including:

a peripheral portion extending generally radially of said drive shaft and connecting said pump casing to said second end of said motor casing, said peripheral portion comprising the only partition separating said pump casing and said motor casing;

a central portion of substantially cylindrical configuration extending axially from said peripheral portion about said drive shaft;

first supporting means rigid with said central portion and stationarily supporting said fixed second annular sealing element;

second supporting means rigid with said central portion and stationarily supporting said second bearing; and said first and second supporting means being located at fixed positions spaced axially of said central portion;

whereby during operation relative distances between said second bearing, said movable first annular sealing element and said fixed second annular sealing element are maintained substantially constant by said first and second supporting means, thereby maintaining said seal, under conditions tending to reduce the biasing force of said spring means and to cause said movable first annular sealing element to move axially of said fixed second annular sealing element.

2. A machine as claimed in claim 1, wherein said first supporting means comprises an annular projection extending radially inwardly from the internal wall of said central portion and defining therewith an annular recessed seat for said fixed second annular sealing element.

3. A machine as claimed in claim 2, further comprising a retaining bush press fit between said recessed seat and said fixed second annular sealing element.

4. A machine as claimed in claim 1, wherein said second supporting means comprises an annular projection extending radially inwardly from the internal wall of said central portion and defining therewith an annular recessed seat for said second bearing.

5. A machine as claimed in claim 4, wherein said second bearing includes an outer race directly press fit onto said recessed seat and an inner race abutting a step formed in said drive shaft.

6. A machine as claimed in claim 1, wherein said first and second supporting means and said central portion are formed integrally of one piece construction.

7. A machine as claimed in claim 1, wherein said first supporting means and said central portion are formed integrally of one piece construction, and said second supporting means comprises a separate member fixedly joined to said central portion.

* * * * *